US008322990B2

(12) United States Patent
Hunt et al.

(10) Patent No.: US 8,322,990 B2
(45) Date of Patent: Dec. 4, 2012

(54) VIBRATION DAMPER

(75) Inventors: David J. Hunt, Droitwich (GB); Wesley J. Pearce, Derby (GB); Robert Elliott, Derby (GB)

(73) Assignee: Rolls-Royce PLC, London (GB)

( * ) Notice: Subject to any disclaimer, the term of this patent is extended or adjusted under 35 U.S.C. 154(b) by 576 days.

(21) Appl. No.: 12/458,241

(22) Filed: Jul. 6, 2009

(65) Prior Publication Data

US 2010/0028135 A1 Feb. 4, 2010

(30) Foreign Application Priority Data

Aug. 1, 2008 (GB) ..... 0814018.8

(51) Int. Cl.
*F01D 25/04* (2006.01)

(52) U.S. Cl. ..... 416/119; 416/190; 416/193 A; 416/220 R; 416/500; 415/119

(58) Field of Classification Search ..... 415/119; 416/500, 190, 119 R, 193 A, 193 R, 220 R, 416/119
See application file for complete search history.

(56) References Cited

U.S. PATENT DOCUMENTS 4,182,598 A * 1/1980 Nelson ..... 416/193 A
4,872,810 A * 10/1989 Brown et al. ..... 416/145
4,917,574 A * 4/1990 Dodd et al. ..... 416/193 A
5,156,528 A * 10/1992 Bobo ..... 416/190
5,478,207 A * 12/1995 Stec ..... 416/219 R
6,042,336 A * 3/2000 Bulgrin et al. ..... 416/145
6,450,769 B2 * 9/2002 Szwedowicz ..... 416/190
6,478,544 B2 * 11/2002 Brandl et al. ..... 416/190

FOREIGN PATENT DOCUMENTS

GB 2 112 466 A 12/1983
GB 2 226 368 A 6/1990
GB 2 344 383 A 6/2000

* cited by examiner

*Primary Examiner* — Igor Kershteyn
*Assistant Examiner* — Christopher R Legendre
(74) *Attorney, Agent, or Firm* — Oliff & Berridge, PLC

(57) ABSTRACT

A vibration damper (28) is disclosed for use in a turbomachine, the turbomachine comprising at least one turbine rotor (19) having a plurality of radially extending blades (16, 17). Each blade has an aerofoil (22), a platform (21) and a stem (20). The vibration damper (28) has a seal-region (29) which comprises a pair of sealing surfaces (24, 25) configured for engagement with respective contact surfaces (24, 25) provided on adjacent blade platforms (21). The vibration damper (28) also has a mass-region (30) which is configured to extend radially inwardly from the seal-region (29) and to terminate at a position located between adjacent blade stems (20) (FIG. 4).

12 Claims, 3 Drawing Sheets

VIBRATION DAMPER

The present invention relates to vibration dampers, and more particularly to vibration dampers used between adjacent platform sections of turbine blades of turbomachines such as gas turbines or steam turbines.

A typical turbomachine, such as a gas turbine engine, includes a number of turbine sections comprising a plurality of turbine blades mounted around the periphery of a rotor wheel or disc in close, radially spaced-apart relation. The turbine blades are arranged so as to project into a stream of hot gas in order to convert the kinetic energy of the working gas stream to rotational mechanical energy. Each rotor blade includes a root received in a complementary recess formed in the disc, an aerofoil, and a platform arranged between the root and the aerofoil sections. The platforms of the blades extend laterally and collectively define a radially innermost surface of the core flow path through the engine. This type of general arrangement is illustrated, by way of example, in FIG. 1 showing two adjacent turbine blades 1, 2, each of which has a root region three of "fir-tree" configuration in cross section. The fir-tree root 3 of each turbine blade 1, 2 is received within a complementary recess 4 provided in a central rotor disc 5.

Extending radially outwardly from the fir-tree root 3, each rotor blade 1, 2 has a widening stem region 6 beyond which a respective laterally extending platform 7 is provided. Positioned radially outside the platform 7 is an aerofoil region 8 which, in the arrangement illustrated, is provided with a plurality of cooling apertures 9 in a generally conventional manner.

During engine operation, vibrations typically occur between the turbine blades 1, 2 and the rotor disc 5, and between the turbine blades 1, 2 themselves. Unchecked, this vibration can lead to fatigue of the turbine blades and so it is necessary to provide an arrangement in order to dissipate the energy of these vibrations. This is commonly done by inserting vibration dampers between the adjacent turbine blades, the dampers being arranged to bear against opposed contact surfaces of adjacent blade platforms 7, such as the converging contact surfaces 10, 11 illustrated in FIG. 1.

A typical vibration damper of this type is illustrated at 12 in FIG. 2 and it can been seen that in the operating position illustrated generally in FIG. 2, the damper 12 also performs a secondary function of sealing the small gap 13 between adjacent blade platforms 7. By sealing the gaps 13 between adjacent turbine blades in this manner, the hot gas from the working fluid-flow through the engine is prevented from flowing below the platforms 7, thereby eliminating a source of inefficiency in the gas turbine engine. Additionally, sealing the gaps 13 between adjacent platforms 7 allows the supply of a flow of cooling gas through the spaces between adjacent stems 6, without the cooling gas escaping into the working hot gas flow of the engine.

Each vibration damper 12 is arranged so as to have a pair of convergent planar sealing surfaces 14,15 which are urged into sealing engagement with respective convergent contact faces 10,11 of the blade platforms 7 when the damper 12 is subjected to centrifugal loading during operation of the engine. When contact is made between the sealing surfaces 14, 15 of the damper 12 and the contact surfaces 10, 11 of the blade platforms 7, relative movement between neighbouring turbine blades results in sliding movement between the contact surfaces 10, 11 and their respective sealing surfaces 14, 15, thus dissipating vibration energy.

However, it has been found that previously proposed vibration dampers 12 of the general type described above can suffer from a number of disadvantages. For example, conventional dampers can have insufficient mass to provide effective damping. Also, vibration dampers of the type described above often don't provide particularly effective damping in the case of vibrations occurring as a result of primarily radial relative movement between adjacent turbine blades.

It is therefore an object of the present invention to provide an improved vibration damper for use in a turbomachine. It is another object of the present invention to provide a turbomachine incorporating such an improved vibration damper.

Accordingly, a first aspect of the present invention provides a vibration damper for use in a turbomachine comprising at least one turbine rotor having a plurality of radially extending blades, each blade having an aerofoil, a platform located radially inwardly of the aerofoil, and a stem located radially inwardly of the platform; the vibration damper having: a seal-region comprising of a pair of sealing surfaces configured for engagement with respective contact surfaces provided on adjacent blade platforms, and being characterised by having a mass-region configured to extend radially inwardly, relative to the rotor, from the seal-region and to terminate at a position located between adjacent blade stems.

Preferably, the mass-region is generally elongate in form and may have a relatively narrow section adjacent the seal-region and a relatively large section radially inwardly thereof.

In another preferred arrangement, the vibration damper has its centre of gravity located substantially within, or generally adjacent, the mass-region.

The seal-region of the vibration damper may be shaped such that the sealing surfaces converge in a radially outward direction relative to the rotor, for engagement with similarly converging contact surfaces provided on adjacent blade platforms.

Preferably, the sealing surfaces make an acute angle to one another.

The seal-region may preferably be shaped such that a first one of said pair of sealing surfaces lies in a substantially radial plane relative to the rotor, for engagement with a radial contact surface provided on one of the adjacent blade platforms.

The vibration damper may have a mass-distribution such that a line of centrifugal force, acting upon the damper during rotation of the rotor, passes through a mid-chord region of the second of said pair of sealing surfaces.

In a preferred arrangement, the seal-region of the vibration damper has a retaining projection configured for loose engagement within a corresponding retaining recess formed in one of the adjacent blade platforms, for retention within said recess when centrifugal forces acting on the vibration damper are insufficient to urge the seal-surfaces into engagement with the contact surfaces of the blade platforms.

According to another aspect of the present invention, there is provided a turbomachine having at least one turbine rotor comprising of plurality of vibration dampers of the type identified above.

In a preferred arrangement of the turbomachine, each blade of the rotor comprises an aerofoil, a platform located radially inwardly of the aerofoil, and a stem located radially inwardly of the platform, the platform being configured to define a first contact surface to one side of the aerofoil, and a second contact surface to the opposite side of the aerofoil, the first contact surface lying in a substantially radial plane relative to the rotor, and the second contact surface lying in a plane making an acute angle to the radial plane.

Preferably, said first contact surface is provided on the suction side of the aerofoil, and said second contact face is provided on the pressure side of the aerofoil.

Furthermore, the platform of each rotor blade preferably comprises a projection located substantially radially inwardly of the second contact surface in order to define a recess between the second contact surface and the projection.

Each vibration damper is then provided such that its seal region is located substantially in a space defined between the first contact surface of one blade, and the second contact surface of an adjacent blade. In order to retain the vibration damper in this general position even when not subjected to any centrifugal load, part of the seal-region of the vibration damper extends into said recess, to be loosely located therein.

Embodiments of the invention will now be described by way of example with reference to the accompanying drawings in which.

As indicated above, prior art vibration dampers for gas turbine engines take the form of a solid mass having a pair of converging planar surfaces arranged to make contact with angled surfaces provided on two neighbouring turbine blade platforms when the damper is subjected to centrifugal loading during rotation of the turbine. It will therefore be clear that such an arrangement necessitates the provision of turbine blades having a contact surface provided on both sides of the aerofoil section of the blade, both of those contact surfaces being angled relative to a radial plane. Such an arrangement has been found to suffer from a number of disadvantages.

Figure 1:
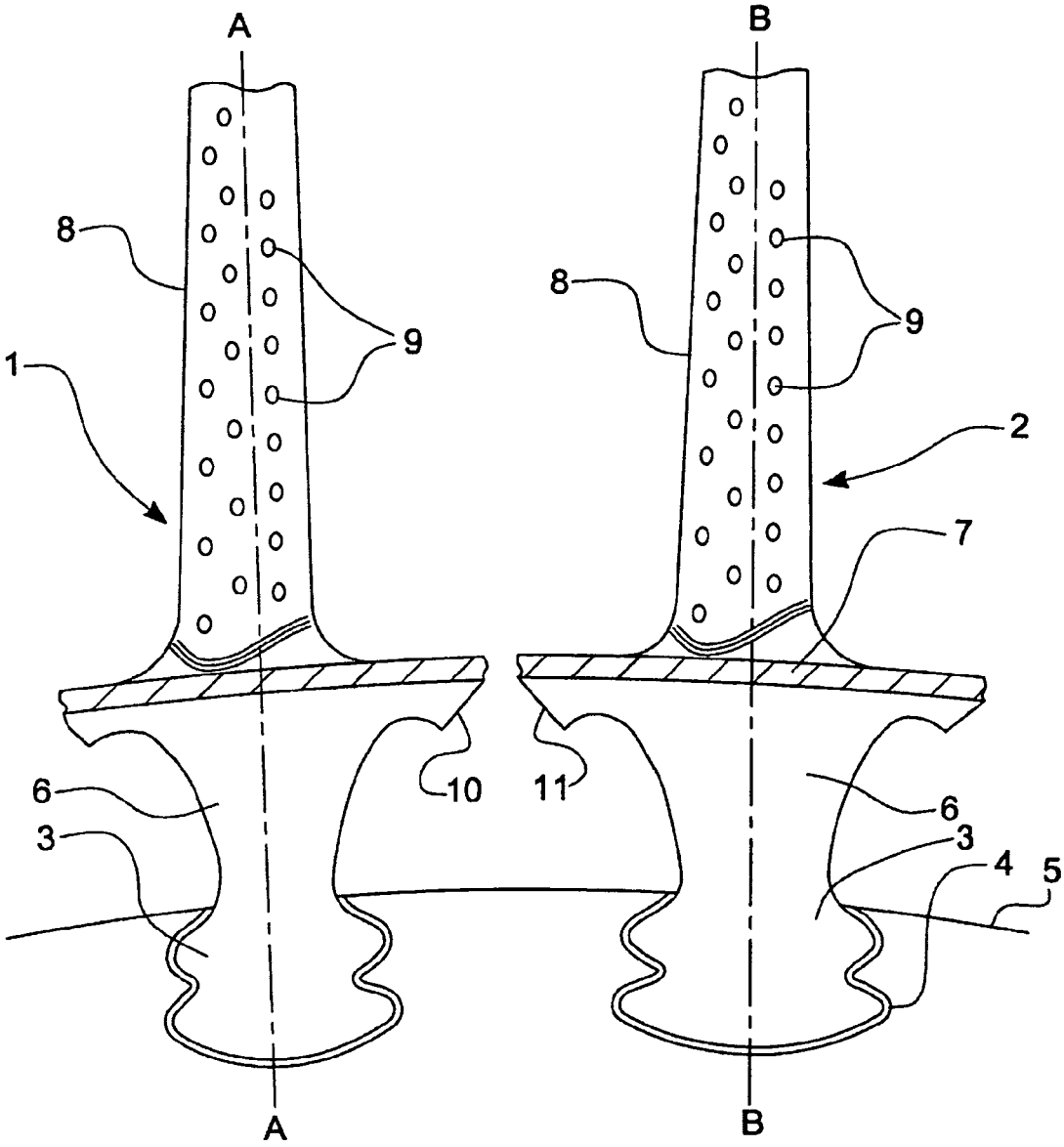
FIG. 1 RELATED ART
FIG. 1 shows a generally conventional arrangement of adjacent turbine blades arranged radially around a rotor disc.
Figure 2:
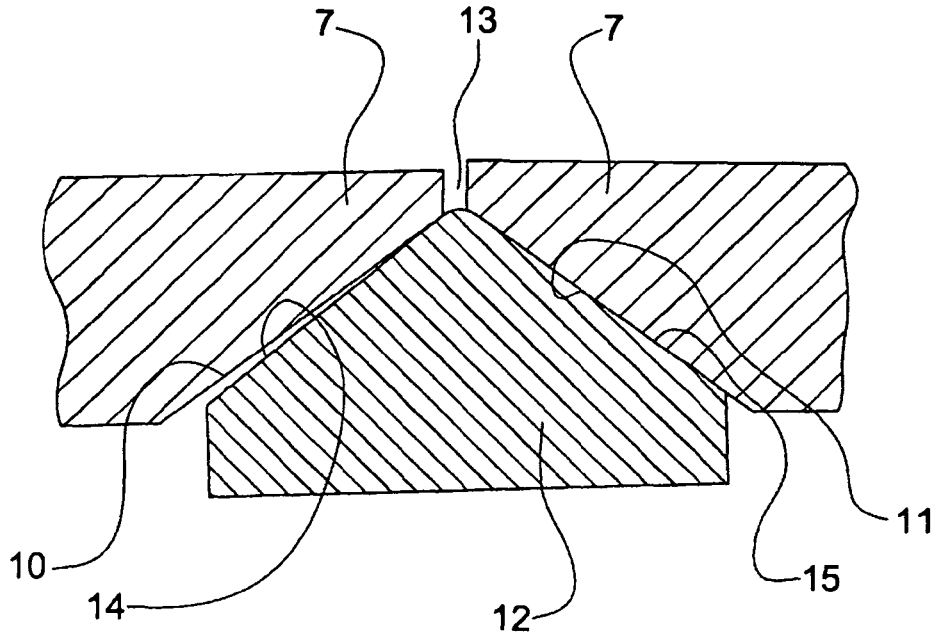
FIG. 2 RELATED ART
FIG. 2 illustrates a prior art vibration damper arrangement (described above)

The first of these disadvantages will be evident from a consideration of FIGS. 1 and 2 from which it can be seen that in order to provide an arrangement of this sort of configuration, material removal operations must be performed on both sides of the platform in order to produce the required contact surfaces. This becomes a particular problem where a damper needs to be retrofitted to an existing blade design, because the available under-platform space can be limited by the existing form of the blade casting. In such situations, it can often be problematic to machine appropriate cavities into the platforms on both sides of a turbine blade, for reasons of cost and due to the creation of mechanical stresses in the structure.

Figure 3:
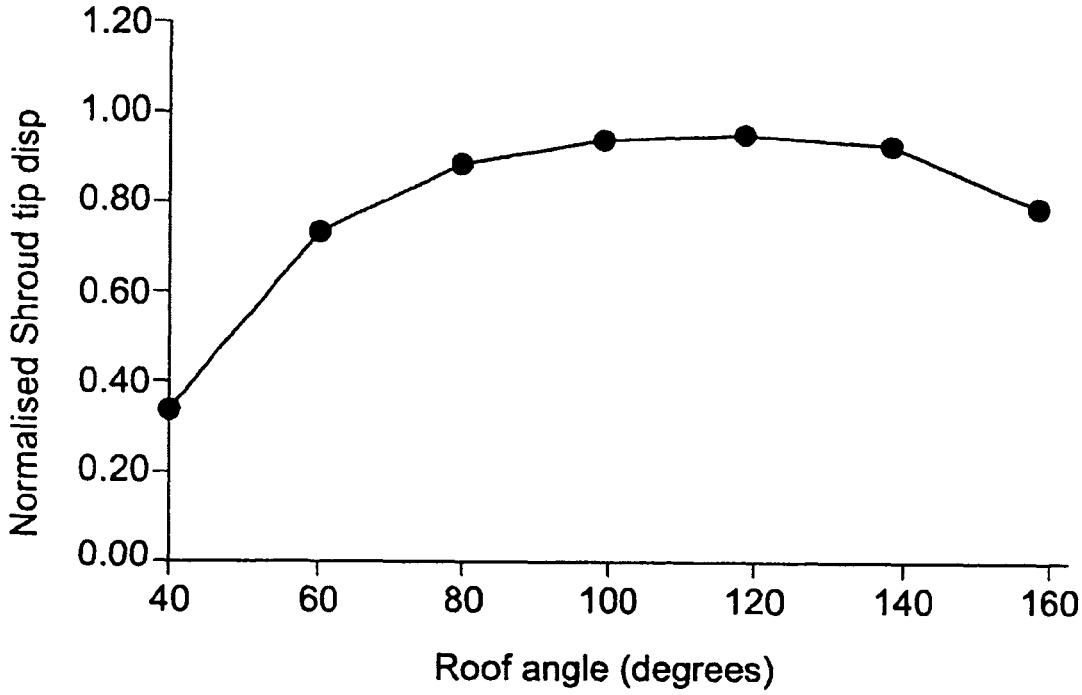
FIG. 3 shows a plot of turbine blade tip-displacement against the angle between contact surfaces of adjacent blade platforms, for a particular mode of vibration.

Furthermore, it has been found that in situations where vibration results in relative movement between neighbouring turbine blades in a primarily radial direction, vibration energy can be more effectively dissipated if the angle between adjacent converging contact faces of the neighbouring turbine blades is reduced (i.e. if the contact faces, or at least one of the contact faces, of a pair of neighbouring turbine blades tends towards the radial direction relative to the turbine rotor). This effect is illustrated in FIG. 3 which shows a plot of blade tip-displacement against the "roof angle" between neighbouring converging contact faces. As can be seen, as the "roof angle" is reduced, so the level of tip displacement during vibration reduces.

Figure 4:
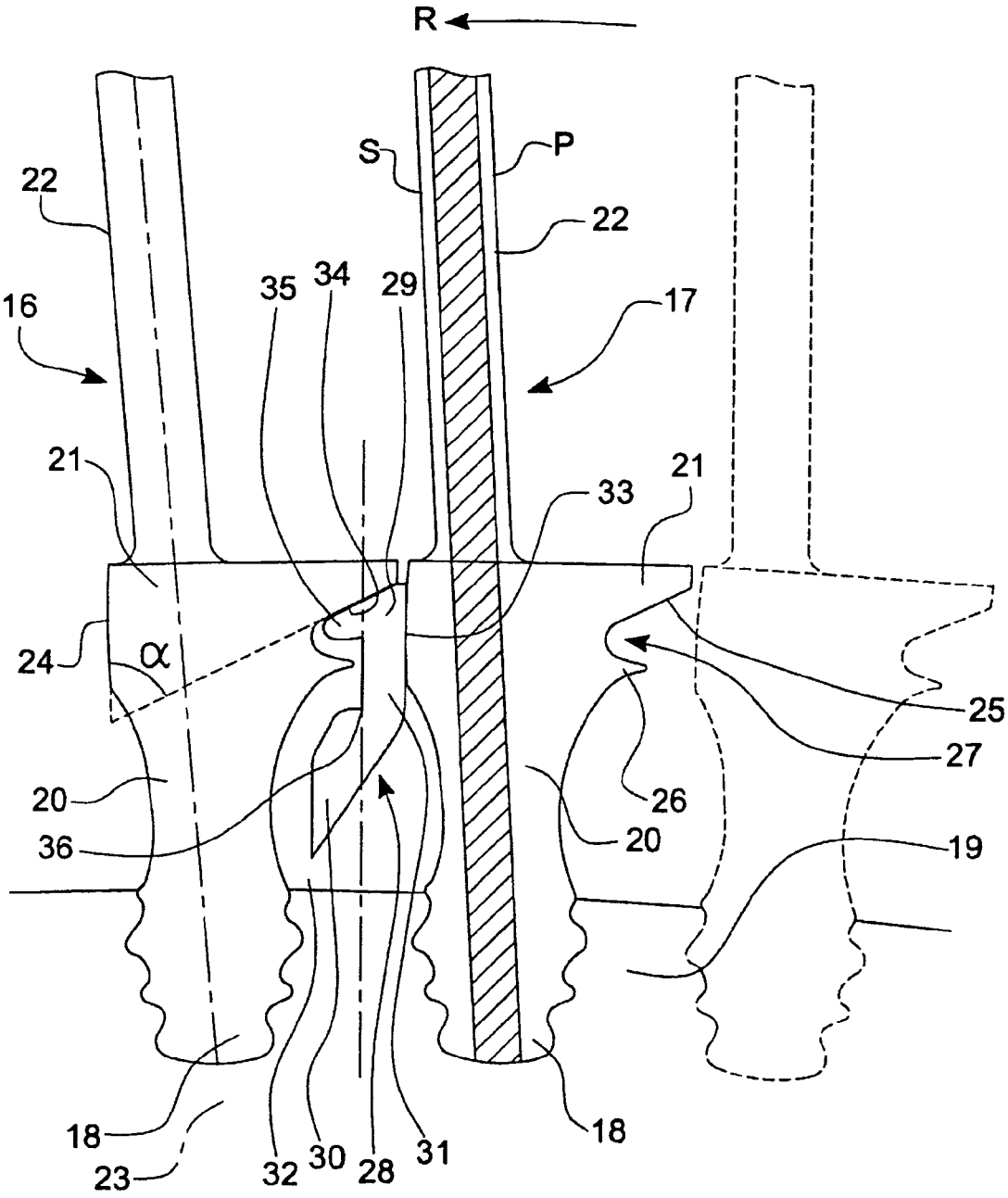
FIG. 4 is a schematic cross-sectioned view illustrating a vibration damper in accordance with the present invention.

FIG. 4 illustrates an arrangement in accordance with the present invention, showing a pair of adjacent turbine blades 16, 17. The turbine blades are shown in cross-section through their points of maximum chord depth. Each blade has a pressure side P and a suction side S, and comprises a radially innermost fir-tree root engaged within a respective complementary recess formed in a rotor disc 19. As will be appreciated, during operation, the rotor disc will thus be caused to rotate in an anticlockwise direction R as illustrated in FIG. 4.

Each turbine blade 16, 17 also comprises a respective stem region 20 which extends radially outwardly from the fir-tree root 18 and which carries a platform 21, beyond which a respective aerofoil section 22 extends generally radially with respect to the rotor 19. Each platform 21 defines a first contact surface 24 on the suction side of the blade axis 23, and a second contact surface 25 on the pressure side of the blade axis 23.

The first contact surface 24 of each turbine blade 16, 17 is arranged so as to lie in a plane substantially radial relative to the rotor 19. However, the second contact surface 25 of each turbine blade lies in a plane making an acute angle $\alpha$ relative to the first contact surface 24.

Each platform region 21 is also provided with a small projection 26, extending generally (laterally relative to the rotor 19) at a position spaced radially inwardly of the angled second contact surface 25. A recess 27 is thus defined between the projection 26 and the angled second contact surface 25. The recess 27 is thus provided in the platform 21 on the pressure side P of the blade. This is preferred over the alternative of cutting the recess 27 into the suction side S of the blade, because at the maximum chord-depth position the suction surface of the blade is positioned very close to the edge of the platform as can be seen in FIG. 4. A recess 27 cut into the suction side S of the blade would thus be very close to the path along which centrifugal load is transmitted through the platform 21, indicated by the shaded region in FIG. 4. By cutting the recess 27 into the platform on the pressure side P of the blade, the recess is clear from this load path. Also, turbine blades are typically designed such that the suction side S carries more of the load because the leading and trailing edges are usually hotter, may have cooling holes, and are generally more exposed to impact from debris.

A vibration damper 28 is provided between the adjacent turbine blades 16, 17. The vibration damper 28 can be considered to have a radially outermost seal-region 29 and a radially innermost mass-region 30, the seal-region and the mass-region being interconnected by a relatively narrow neck-region 31. As can be seen from FIG. 4, the seal-region 29 is located, in use, generally between the platform regions 21 of adjacent turbine blades, whilst the radially inwardly extending mass-region 30 is located in the space 32 provided between adjacent turbine stems 20.

The seal-region 29 of the damper defines a first sealing surface 33 which is shown to lie in a substantially radial plane relative to the rotor 19 and is thus provided for sealing engagement with the first contact surface 24 of the adjacent blade 17. A second sealing surface 34 is also provided and which lies in a plane making an acute angle $\alpha$ relative to the first sealing surface 33. In this manner, the second sealing surface 34 is provided for sealing engagement with the second contact surface 25 of the adjacent turbine blade 16.

As can also been from FIG. 4, the relatively narrow neck region 31 of the damper 28 extends from the seal-region 29 in a radially inward direction, past the relatively narrow space between the projection 26 of one turbine blade 16, and the lowermost region of the first contact surface 24 of the neighbouring turbine blade 17. The seal-region 29 can thus be considered to define a stepped projecting region 35 which extends outwardly relative to the neck-region 31 and which is received within the recess 27 formed between the two blades. In this manner, the seal-region 29 of the damper 28 is held loosely captive within the space provided between the adjacent blade platforms 21. This means that when the turbomachine is not running, such that the rotor 19 is stationary, the uppermost dampers 28 provided around the rotor will simply hang under the force of gravity, with their stepped projecting regions 35 engaged on respective projections 26, thereby retaining the seal-regions 29 of each damper within its allotted space between adjacent blade platforms 21, and in correct alignment such that its sealing surfaces 33, 34 become properly pressed into sealing engagement with the contact surfaces 24, 25 of the blades under centrifugal loading when the turbomachine is subsequently started up and centrifugal forces are caused to act on the damper 28.

As discussed above, the angled second contact face 25 and the associated recess 25 is provided on the pressure side of each blade platform 21. As the rotor disc initially begins rotating during engine start-up (in an anticlockwise sense as illustrated in FIG. 4), the recess 27 effectively leads the damper. This means that the damper initially loads up on its first sealing surface 24, against the first contact surface 25 of the neighbouring blade, which allows the damper to slide radially outwardly into proper sealing engagement with the opposing contact surfaces 24, 25 of both blades more easily than would be the case if the damper were loading against the angled contact face 25.

The mass-region 30 of the damper can be considered to take the form of a generally elongate tail terminating with an enlarged region at a position between the stems 20 of adjacent blades. The mass-region 30 is shaped such that the majority of its mass lies on same side of the damper as the stepped region 35. This arrangement is effective to ensure that the centre-of-gravity of the entire vibration damper 28, indicated generally at 36 lies substantially radially below a mid-chord point along the second sealing surface 34 of the damper. Preferably, the centre-of-gravity is located within, or at least generally adjacent, the mass-region 30 of the damper. In this manner, the damper 28 has a mass-distribution which is effective such that when the damper 28 is subjected to centrifugal forces during rotation of the rotor, a line of centrifugal force acting upon the damper passes substantially through a mid-chord region of the second sealing surface 34. This is desirable because it helps to provide an even distribution of load across the second sealing surface 34 when the second sealing surface is urged into sealing engagement with the second contact surface 25. If the mass-distribution of the damper were such that the line of centrifugal force acting upon the damper during rotation of the rotor were to act close to the edge of the angled second contact surface 25, then the load would be unevenly distributed across the contact face 25 which could adversely effect the quality of seal provided.

It has been found that a vibration damper of the type described above and illustrated in FIG. 4, provides a number of advantages over the types of prior art arrangement as described above. Firstly, the vibration damper 28 at the present invention can be used with adjacent turbine blades having only one side of their platforms undercut in order to define an angled contact surface 25. Secondly, the damper has a relatively small "roof angle" $\alpha$, and in particular an acute roof angle, which provides improved vibration damping with respect to radial movements between adjacent blades.

Additionally, the radially inwardly extending mass-region 30 allows the overall mass of the damper to be significantly increased relative to prior art arrangements which do not have a mass-region of the type described above. This gives more scope to provide sufficient mass to the dampers to ensure effective damping action.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A vibration damper for use in a turbomachine having at least one turbine rotor, the at least one turbine rotor having a plurality of radially extending blades, each blade including an aerofoil, a platform located radially inwardly of the aerofoil, and a stem located radially inwardly of the platform, the vibration damper comprising:

a seal-region comprising a pair of sealing surfaces configured for engagement with respective contact surfaces provided on adjacent blade platforms; and a mass-region configured to extend radially inwardly from the seal-region and to terminate at a position located between adjacent blade stems, wherein the seal-region is shaped such that: i) a first one of the pair of sealing surfaces lies in a substantially radial plane relative to the rotor, for engagement with a radial contact surface on one of the adjacent blade platforms, and ii) said sealing surfaces converge in a radially outward direction relative to the rotor, for engagement with similarly converging contact surfaces on the adjacent blade platforms, the platform of each rotor blade comprises a projection located substantially radially inwardly of a second contact surface to define a recess between the second contact surface and the projection, the seal-region defines a stepped region, a portion of the seal-region and the stepped region is positioned within the recess, the mass-region is shaped such that the mass-region has a greater mass on a side of the damper having the stepped region than on an adjacent side of the mass-region away from the stepped region, and the side of the mass-region having a greater mass is positioned radially below the recess.

2. The vibration damper according to claim 1, wherein said mass-region is generally elongate in form.

3. The vibration damper according to claim 1, wherein said mass-region has a relatively narrow section adjacent said seal-region, and a relatively large section radially inwardly thereof.

4. The vibration damper according to claim 1, having a centre-of-gravity located substantially within, or generally adjacent, to said mass-region.

5. The vibration damper according to claim 1, wherein said sealing surfaces make an acute angle to one another.

6. The vibration damper according to claim 1, configured so as to have a mass-distribution such that a line of centrifugal force, acting upon the damper during rotation of the rotor, passes through a mid-chord region of the second of said pair of sealing surfaces.

7. The vibration damper according to claim 1, wherein said portion of said seal-region and said stepped region are configured for loose engagement within said recess for retention when centrifugal forces acting on the vibration damper are insufficient to urge the seal-surfaces into engagement with the contact surfaces.

8. A turbomachine comprising:

at least one turbine rotor having a plurality of radially extending turbine blades, each blade including:

an aerofoil, a platform located radially inwardly of the aerofoil, and a stem located radially inwardly of the platform, and a plurality of vibration dampers comprising:

a seal-region comprising a pair of sealing surfaces configured for engagement with respective contact surfaces provided on adjacent blade platforms; and a mass-region configured to extend radially inwardly from the seal-region and to terminate at a position located between adjacent blade stems, wherein the seal-region is shaped such that a first one of the pair of sealing surfaces lies in a substantially radial plane relative to the rotor, for engagement with a radial contact surface on one of the adjacent blade platforms, and the platform of each rotor blade comprises a projection located substantially radially inwardly of a second contact surface to define a recess between the second contact surface and the projection, the seal-region defining a stepped region, a portion of the seal-region and the stepped region being positioned within the recess, the mass-region being shaped such that the mass-region has a greater mass on a side of the damper having the stepped region than on an adjacent side of the mass-region away from the stepped region, the side of the mass-region having a greater mass is positioned radially below the recess, and the plurality of vibration dampers are configured so as to have a mass-distribution such that a line of centrifugal force, acting upon each vibration damper during rotation of the rotor, passes through a mid-chord region of the second of said pair of sealing surfaces.

9. The turbomachine according to claim 8, wherein the platform is configured to define a first contact surface to one side of the aerofoil, a second contact surface to the opposite side of the aerofoil, the first contact surface lies in a substantially radial plane relative to the rotor, the second contact surface lies in a plane making an acute angle to the radial plane, and the aerofoil has a suction side and a pressure side.

10. The turbomachine according to claim 9, wherein said first contact surface is provided on the suction side of the aerofoil, and said second contact face is provided on the pressure side of the aerofoil.

11. The turbomachine according to claim 9, wherein each damper is provided such that the seal-region of each damper is located substantially within a space defined between the first contact surface of one blade and the second contact surface of an adjacent blade.

12. The turbomachine according to claim 8, wherein the plurality of vibration dampers are arranged between adjacent turbine blades of the plurality of radially extending turbine blades.

* * * * *